United States Patent [19]

Murray et al.

[11] 3,958,509

[45] May 25, 1976

[54] IMAGE SCAN AND INK CONTROL SYSTEM

[75] Inventors: James E. Murray, University Heights; Algirdas J. Krygeris, Richmond Heights, both of Ohio

[73] Assignee: Harris Corporation, Cleveland, Ohio

[22] Filed: June 13, 1974

[21] Appl. No.: 478,927

[52] U.S. Cl. ..... 101/426; 101/350; 101/365; 250/559

[51] Int. Cl.[2] ..... B41C 7/08

[58] Field of Search ..... 101/365–367, 101/350, 147, 426; 250/556, 559; 178/DIG. 36

[56] References Cited

UNITED STATES PATENTS

| | | | |
|---|---|---|---|
| 3,051,841 | 8/1962 | Crosfield et al. | 250/220 |
| 3,059,119 | 10/1962 | Zenor | 250/556 |
| 3,185,088 | 5/1965 | Norton | 101/426 |
| 3,339,817 | 9/1967 | French | 101/181 |
| 3,621,130 | 11/1971 | Paine | 178/DIG. 36 |
| 3,708,676 | 2/1973 | Huboi et al. | 250/559 |
| 3,734,630 | 5/1973 | McIntosh et al. | 250/559 |
| 3,741,664 | 6/1973 | Torin | 250/559 |
| 3,792,659 | 2/1974 | Albrecht | 101/365 |
| 3,794,762 | 2/1974 | Zuckerman | 178/DIG. 36 |
| 3,800,699 | 4/1974 | Carley | 101/147 |
| 3,835,777 | 9/1974 | Krygeris | 101/350 |
| 3,841,215 | 10/1974 | Hasegaway | 101/350 |
| 3,853,409 | 12/1974 | Gaillochet | 356/256 |

*Primary Examiner*—Edgar S. Burr
*Assistant Examiner*—William Pieprz

[57] ABSTRACT

A system for predetermining appropriate settings for the ink flow control devices of a printing press in dependence upon the average inked area in each of a plurality of image zones whose ink supply rate is controlled by a respective one of the ink flow control devices. An image-bearing member such as a lithographic printing plate is imaged onto an electronic camera tube where it is scanned. Electrical signals from the camera tube are integrated for each ink control zone and the resultant signals indicate the appropriate settings for the ink flow control devices, which can be remotely controlled. Spatial variations in illumination are compensated; output signals are automatically normalized.

33 Claims, 13 Drawing Figures

IMAGE SCAN AND INK CONTROL SYSTEM

BACKGROUND OF THE INVENTION

The present invention relates to printing presses having a plurality of ink control devices for controlling the flow to different respective circumferential zones of a printing plate for effecting the printing of an image. In particular, the invention relates to predetermining appropriate settings for each of the ink control devices in accordance with the amount of ink required to print the corresponding circumferential portion of the image, the settings being predetermined by analyzing the average amount of printed area to be inked within each portion or zone. The present invention is an improvement upon a system described in U.S. Pat. No. 3,185,088 to R. K. Norton, entitled "Method And Apparatus For Predetermining Settings For Ink Fountain Keys", issued May 25, 1965, and assigned to the assignee of the present invention.

The present invention is related also to a patent application Ser. No. 271,555 by J. Gaillochet, now U.S. Pat. No. 3,853,409 issued Dec. 10, 1974 entitled "A Method Of And Apparatus For Giving Information On The Ink Requirements Of A Printing Forme", filed July 13, 1972, and assigned to the assignee of the present invention.

SUMMARY OF THE INVENTION

The present invention is a system for predetermining settings of ink control devices. In a specific form of the invention a printing plate or other information-bearing member is placed in the field of view of a camera tube such as a television camera tube. The information-bearing member is illuminated and an image of it is produced preferably by optical projection upon a photoelectric surface of the camera tube. An electron density image is produced within the camera tube in accordance with the photoelectric image, and the electron density image is scanned in a raster scan pattern by an electron beam to produce sequential electronic output signals. The signals are integrated or summed with respect to area over each areal portion or zone whose ink supply rate is controlled by a respective ink control device.

Additional features of the invention include the following. The resultant signals are preferably automatically compensated for spatial variations in illumination of the image, the necessary calibration data being stored in advance. The signals are normalized to take account of the offset and the span between 0% and 100% inked areas of printing plates. The resultant integrated signals may if desired be recorded and/or displayed at an operator's station for the operator's convenience in adjusting the ink control devices.

A plurality of remote control means for controlling respective ink control devices are preferably provided at the operator's control station, preferably in alignment with the zones of the image-bearing member to which they correspond. Also, provision is preferably made for automatically adjusting the respective ink control devices in response to the resultant signals. The field of view of the camera tube is adjustable by adjustment of the size ratio between the image on the photosensitive area and the image-bearing member.

DESCRIPTION OF A PREFERRED EMBODIMENT

Figure 1:
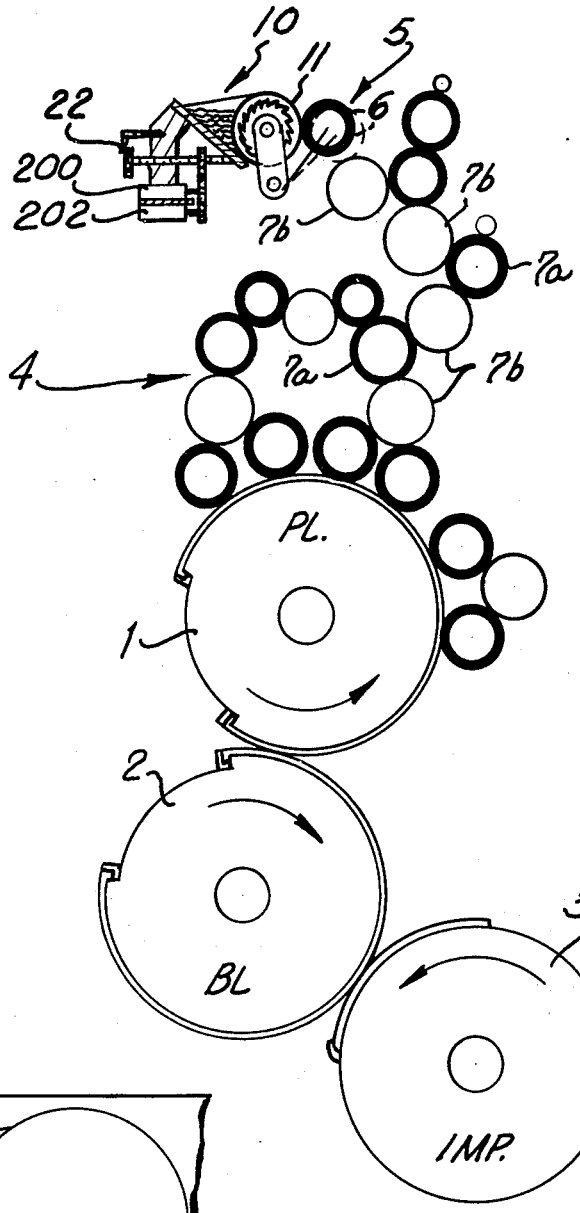
FIG. 1 is a mechanical schematic showing of a lithographic printing press embodying the present invention.
Figure 2:
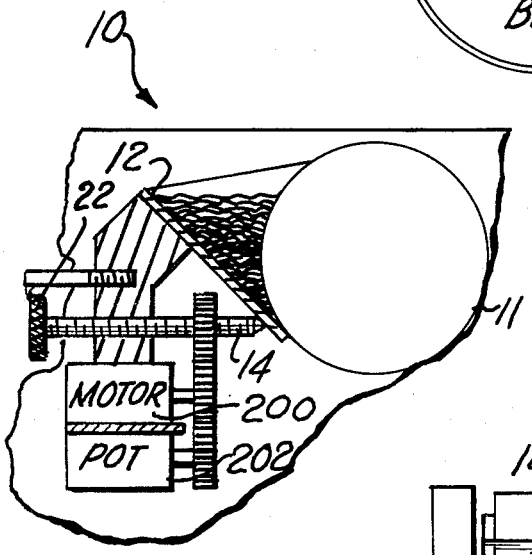
FIG. 2 is an enlarged cross-section of the ink fountain shown in the press of FIG. 1.

A lithographic printing press of a conventional type is shown schematically in FIG. 1. The press has a plate cylinder 1, a blanket cylinder 2, and an impression cylinder 3. The plate cylinder is inked by a conventional inker 4 which comprises an ink fountain 10, an adjustable ducting mechanism 5 including a duct roll 6, a plurality of ink transfer and vibrating rolls *7a*, *7b*, between the ducting mechanism 5 and the plate cylinder 1. The ink fountain 10 is shown in cross section in FIG. 2 and comprises a fountain roll 11 which can rotate in the fountain and a fountain blade 12 which is adjustable toward and away from the fountain roll 11 to vary the ink flow from the fountain. The fountain blade 12 extends the length of the fountain roll 11, and a plurality of ink keys in the form of screws 14, 15, 16, 17, 18, 19, and 20 engage the underside of the fountain blade 12 to determine its spacing from or pressure against the fountain roll. Although a printing press may have any number of ink keys for each fountain roll, for example forty-six keys, a press having only seven keys per roll is described herein for greater clarity of the drawings and description.

Figure 3:
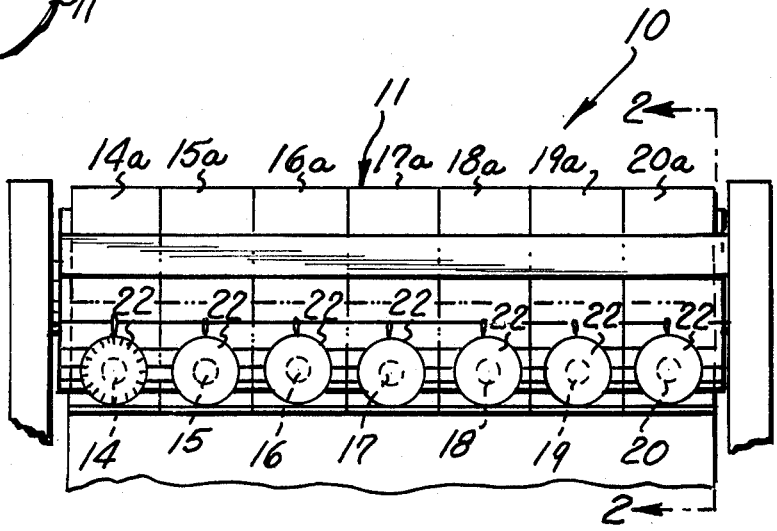
FIG. 3 is a side elevational view of the ink fountain of FIG. 2.
Figure 4:
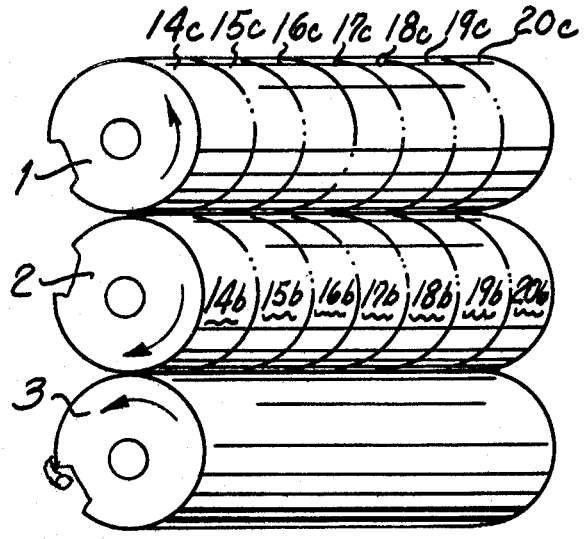
FIG. 4 is a schematic showing of the plate, blanket, and impression cylinders of a lithographic press.

The settings of the respective ink keys determine the amount of ink supplied to a corresponding circumferential zone of the printing plate during each revolution of the plate. The amount of ink to provide a given ink density on the printed image is a direct function of the image area in the particular zone. The ink thickness on various circumferential zones of the fountain roll is thus determined by the settings of the ink keys 14–20, FIG. 3. Each of the ink keys 14–20 is adjustable by means of a respective motor 200 or a manual knob 22 at one end of the key. The settings of the ink keys therefore determine the thickness of the ink film in respective circumferential zones on the fountain roll, these zones being designated by the reference numerals 14*a*, 15*a*, 16*a*, etc. The blanket cylinder 2 is shown as having seven zones, 14*b*, 15*b*, 16*b*, etc. whose ink film thickness is controlled by the seven fountain keys 14–20 respectively.

The plate cylinder 1 also has corresponding zones, 14*c*, 15*c*, 16*c*, etc. and the printed images can also be divided into approximate longitudinal ink key zones in which the thickness of the ink in the image area of the zone (ink density) is controlled by the settings of corresponding ones of the ink keys 14–20. Thus, if an ink key position is changed, the thickness of the ink film on the image portions of a corresponding circumferential zone of the plate cylinder (ink density) and, in turn, the amount of ink supplied to and the ink density on a corresponding longitudinal zone of the printed page, is changed.

Figure 5:
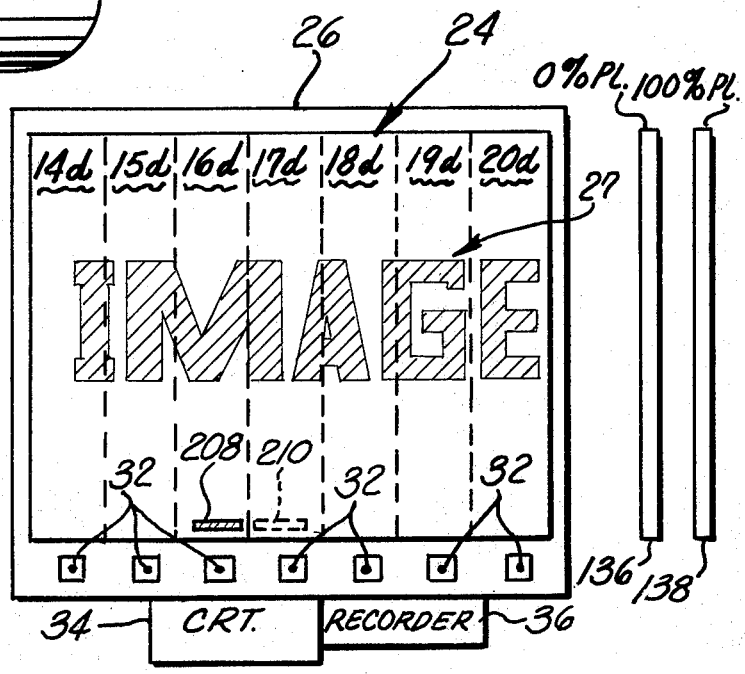
FIG. 5 is a top view of a portion of the operator's station showing a printing plate lying flat, remote control switches, a recorder, and a cathode ray tube display.

In accordance with the present invention, a lithographic printing plate 24 bearing an image to be printed is scanned to determine approximate settings of the ink keys 14–20. The printing plate 24 carrying the image to be scanned is illustrated in FIG. 5 in a flat position. It has seven zones 14*d*, 15*d*, 16*d*, etc., each of which corresponds to that portion of the image whose ink supply rate is controlled by the key in the ink fountain that has the same reference numeral as the zone without the "*d*" suffix. The image or inked portions of the printing plate pattern have a different light reflecting characteristic than plate portions bearing non-image portions of the pattern.

Figure 6:
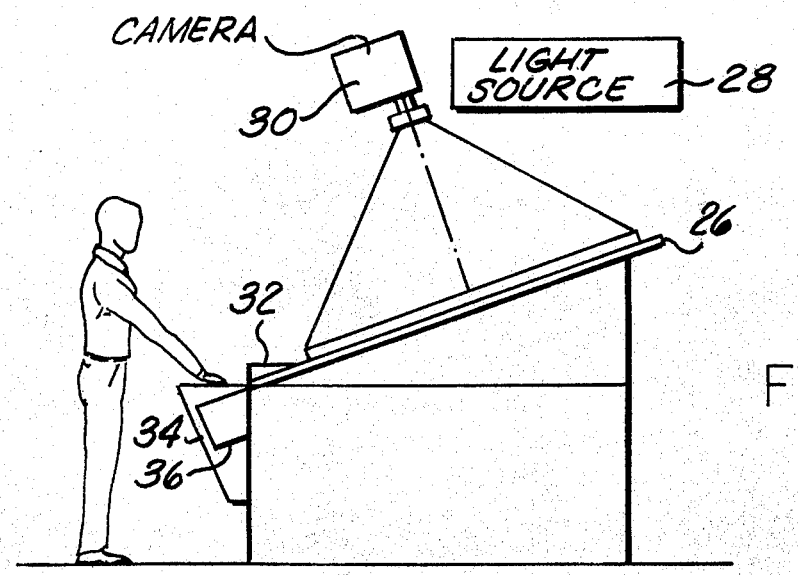
FIG. 6 is a side view of the operator's station of FIG. 5 equipped with apparatus of the present invention.

The printing plate 24 to be scanned is place on a table 26 preferably at an operator's station as shown in FIGS. 5 and 6, from which the ink keys 14–20 can be remotely controlled. The plate 24, which has an original image 27, is illuminated by a light source 28. Light reflected from the plate 24 is received by black and white vidicon camera 30. In the top view, FIG. 5, of the table 26 which supports the printing plate 24, remote control switches 32 for adjusting respective ones of the ink keys 14–20 are shown in alignment with the zone whose respective ink supply is controlled by each of the switches 32. FIG. 5 also shows a cathode ray tube (CRT) display device 34 for displaying the percentage of zonal area to be inked in each of the zones 14*d*, 15*d*, 16*d*, etc. Preferably the CRT display shows this percentage as the amount of vertical deflection of the CRT beam for each zone, where each zone is represented by a segment of the horizontal deflection sweep of the beam, the segments being marked with zone numbers. A recording device 36, which in the present embodiment is a magnetic tape recorder, records digital data representing these same percentages.

Figure 7:
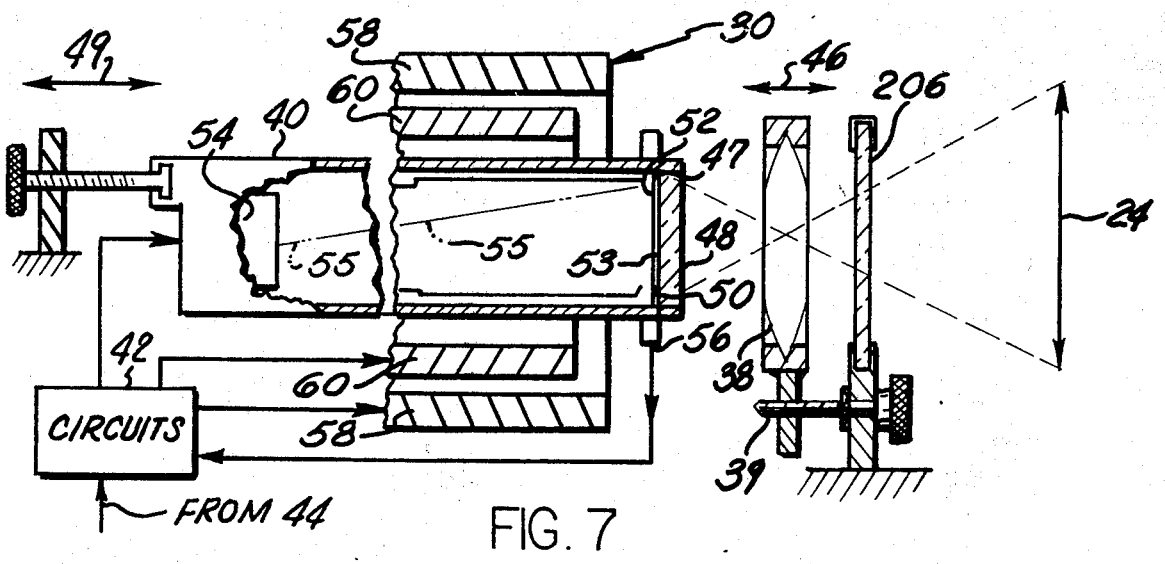
FIG. 7 is a cutaway view of a portion of a camera tube and its associated optical apparatus.

The camera 30 includes a lens 38, FIG. 7, a vidicon camera tube 40 of conventional design, and conventional camera circuits including sweep signal generating circuits 42. The printing plate 24 with its original image reflects light through the converging lens 38, whose position is axially adjustable by a screw 39 as shown by vectors 46 to permit a desired degree of focusing or defocusing of an image 47 in the vidicon tube 40. The position of the camera 30 is also adjustable as shown by the vectors 49, so that a desired size ratio between the plate 24 and its image in the tube 40 can be achieved. The vidicon tube has an end window 48, the inner surface of which is coated with a transparent conductive film 50 which serves as an electrode for taking a video signal from the tube 40.

A photosensitive layer 52 is deposited on the conductive film 50, the layer being formed of photoconductive globules. Light from the plate 24 falling upon the photoconductive film 52 causes electrical current flow through the globules which produces a capacitive charge on the globules. The photosensitive layer therefore has an image 53 similar to the image on the plate 24, the image being formed of electrical charges.

The charge image 53 on the photoelectric surface 52 is scanned by a low velocity electron scanning beam 55 produced by an electron gun 54 of the vidicon tube 40. The electron beam discharges the positive charges that were produced by current leakage of the globules of film 52, to produce a capactive current flow in the transparent electrode 50. This current flow represents the video signal which is drawn from the tube at a ring-shaped video signal electrode 56, all of which is well known to those skilled in the art of camera tubes. The electron beam 55 is focused by a focusing coil 58 and is deflected by horizontal and vertical deflection coils 60 that are energized by the sweep circuits 42 in accordance with horizontal and vertical synchronizing signals produced by an external synchronizing signal generator 44.

The camera tube 30 need not be limited to types of tubes having a scanning electron beam.

Figure 8:
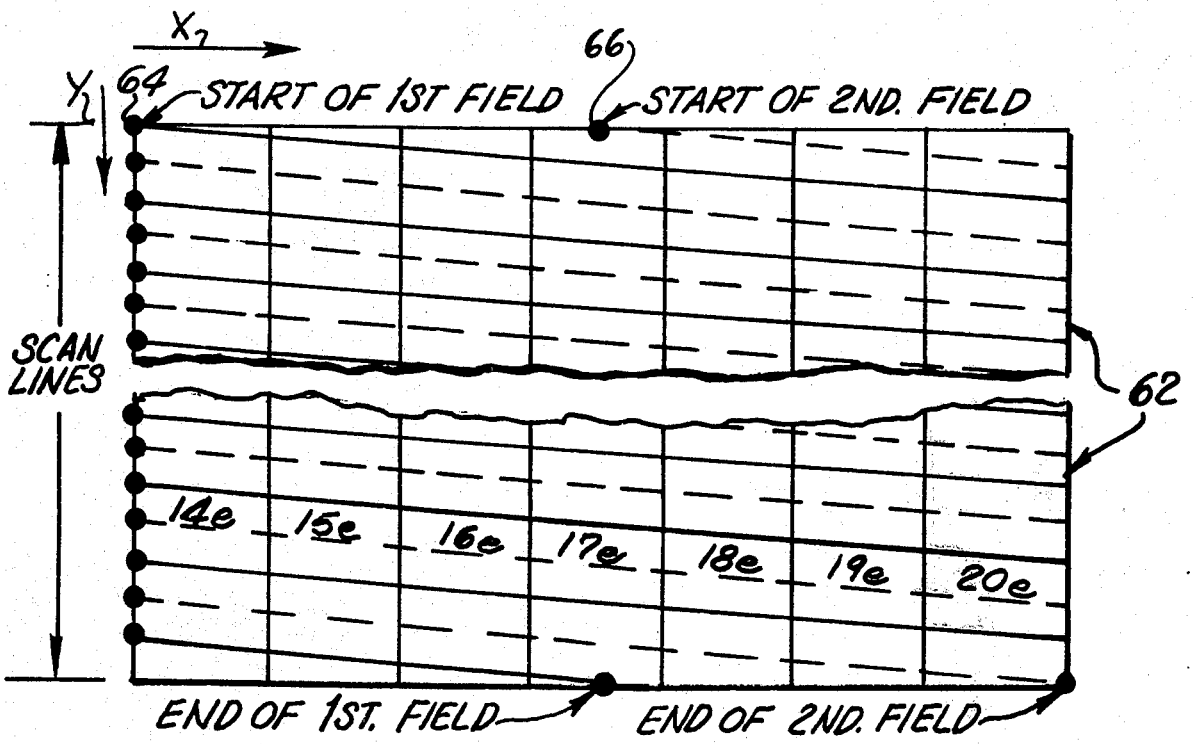
FIG. 8 is a diagram of an electron beam raster scan pattern showing zones corresponding to ink control devices.

The electron beam 55 scans the photosensitive image area 52 in a raster scan pattern 62 that is commonly used in television camera tubes, FIG. 8. Each frame of the raster comprises two interlaced scanning fields 64, 66, each having 262½ lines, so that the raster has 525 lines per frame. About 480 lines per frame are usable, the others being lost during retrace time intervals, etc. Zones of the electron charge image are shown on the raster, FIG. 10, and designated as 14*e*, 15*e*, 16*e*, etc. to correspond to respective portions of the image of the plate 24 and of the ink keys 14–20.

Figure 9A:
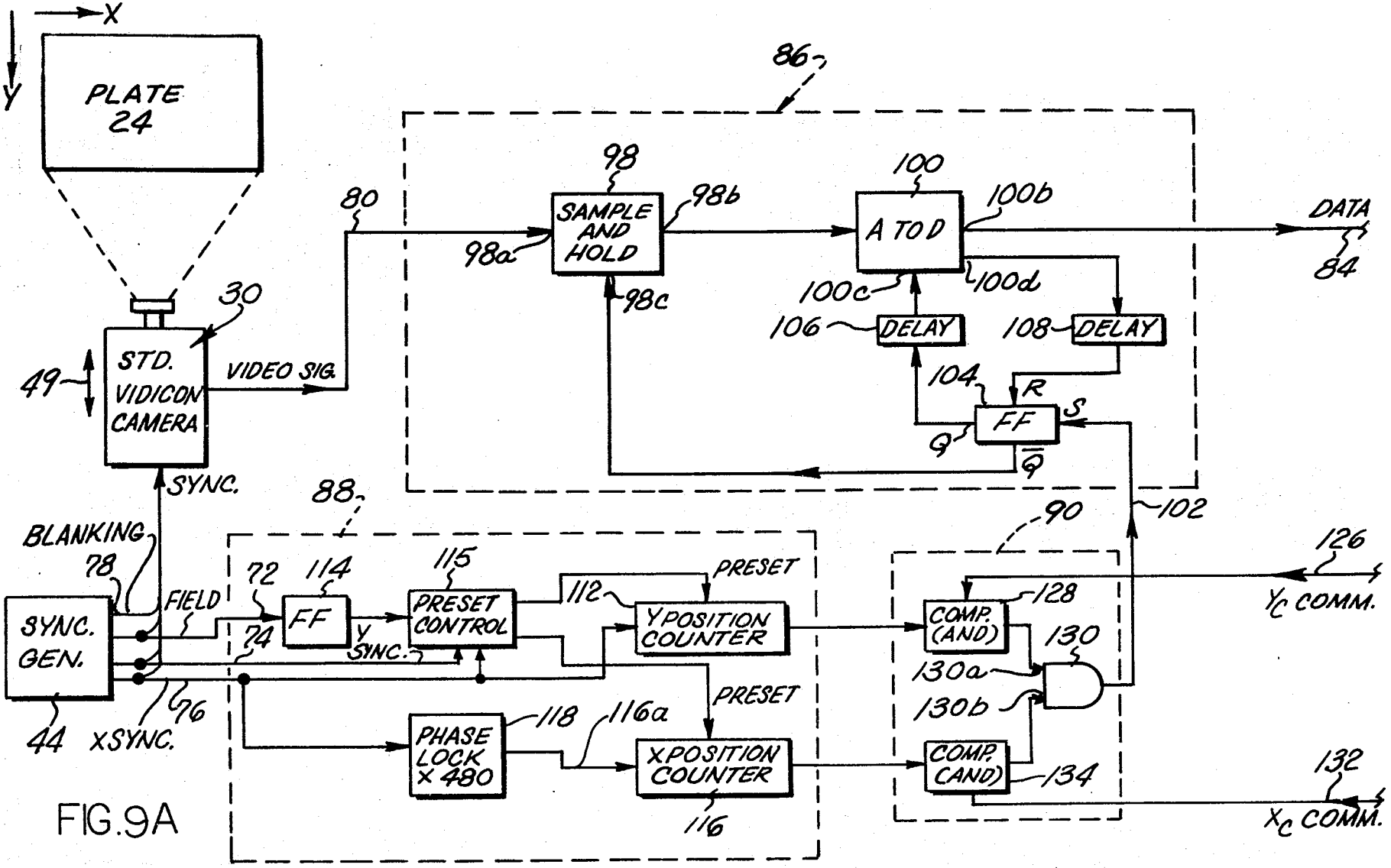
FIGS. 9A and 9B are electronic block diagrams of the system for predetermining the settings of ink control devices.
Figure 9B:
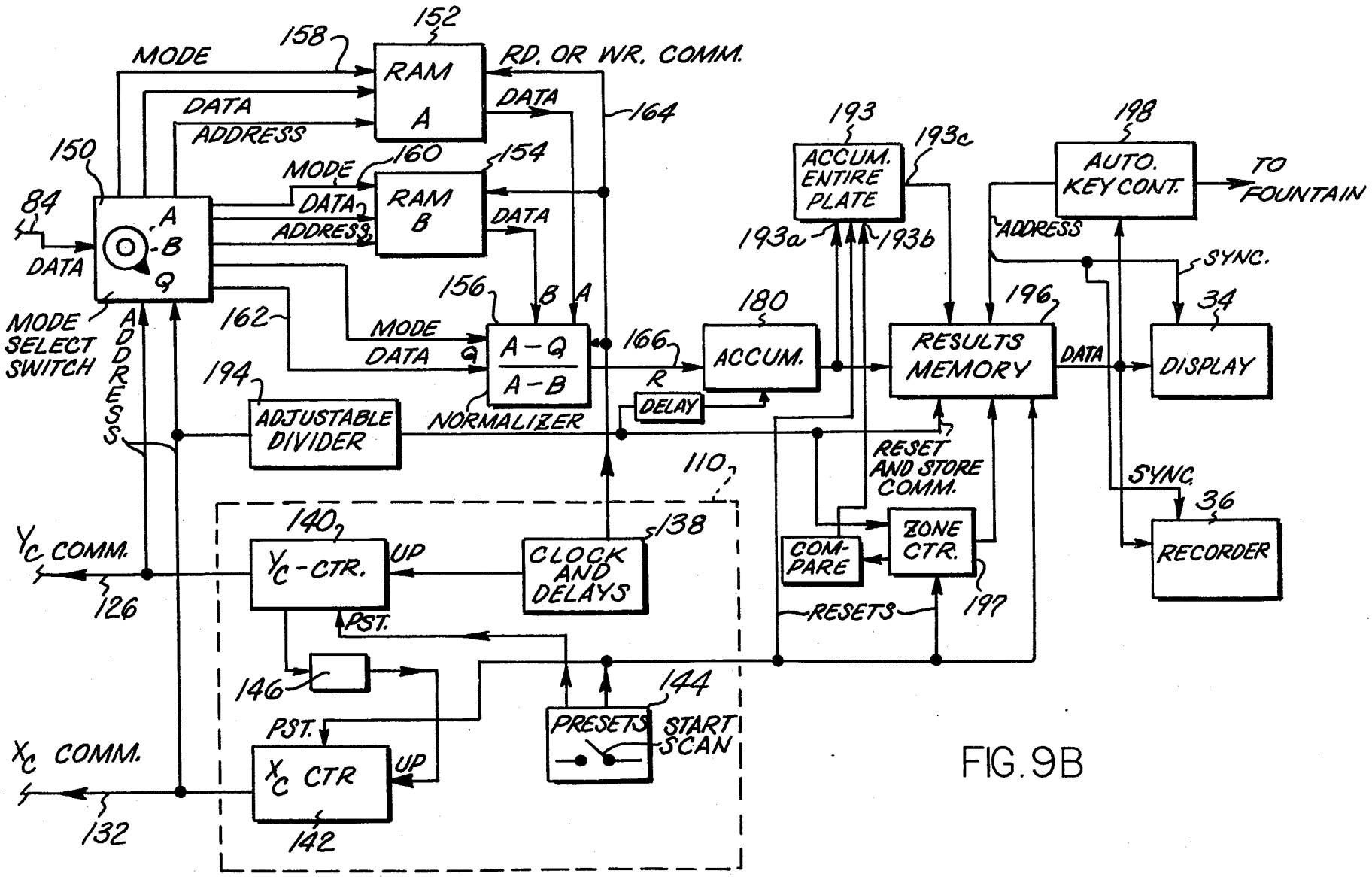

Electronic circuits of FIGS. 9A and 9B process the data signals produced by the vidicon camera 40. The camera 40, including its sweep circuits 42 and miscellaneous other conventional and well known ancillary circuits such as power supplies, are included in a block 30 of FIG. 9A. The synchronizing signal generator 44 provides a field interlace control signal on a line 72, which is a binary signal for selecting either the first or second field 64, 66, and also provides Y coordinate (i.e. vertical coordinate) synchronizing signals on a conductor 74, X coordinate (i.e. horizontal coordinate) synchronizing signals on a conductor 76, and a composite X, Y blanking signal on a conductor 78 as shown in FIG. 9A. The synchronizing signal generator 44 and all of its output signals are standard and well known in television technology.

Some types of commercially available vidicon cameras provide a video output signal which is internally combined with synchronizing signals that are provided by the external synchronizing signal generator 44. The video output signal on a line 80 emanating from the vidicon camera equipment 30 can either be taken from the video electrode 56 without combining of the video signals with any synchronizing signals or, if preferred in order to use a standard television camera of the foregoing type without modifications, the synchronizing signals can be combined in the camera 30 with the video signals of electrode 56 and the undesired synchronizing signals can later be suppressed by conventional threshold circuits in the camera equipment 30, as is done herein. The vertical and horizontal synchronizing signals are in the blacker-than black portion of the composite video signal, which occupies the blackest 25% of the signal range, as is well known, and can therefore be suppressed simply bypassing the composite signal through any circuit whose output signal range does not extend through the blacker-than-black portion.

The video signal on the camera output conductor 80 is conducted to sampling and digitizing circuits which take readings of the analog video signal at various controlled times and produce digital output data at a conductor 84 representing each such reading. The sampling and digitizing equipment includes a video data sampler and digitizer 86, hereinafter referred to as the video digitizer 86, a beam position tracker 88, and a beam position comparator 90.

The video digitizer 86 samples and holds the instantaneous video signal from the vidicon camera whenever a sampling command pulse is produced in the system, and converts the sampled analog signal into digital signals. The video signal is conducted to a conventional sample-and-hold device 98. A command to take a sample is a 0 signal at a control terminal **98*c* of that device. Upon a command to take a sample, the video signal at an input terminal 98*a* of the sample-and-hold device 98 is held at an output terminal 98*b***.

The analog signal at the sample-and-hold output terminal **98*b* is converted to a digital signal by an analog-to-digital converter 100, the digital signal appearing at the converter's output terminals 100*b*. The analog-to-digital converter 100** is a conventional commercially available device produced by several companies including Analog Devices, Inc., and available with a variety of features from the various manufacturers.

To start the time sequence of operation of the video digitizer 86, a sampling command signal on a conductor 102 sets a bistable circuit 104, whose negated output Q becomes zero. This signal is applied to the terminal **98*c* of the sample-and-hold device 98 to start the holding of the video voltage that then exists at the terminal 98*a*. In the meantime an asserted output Q from the bistable circuit 104 initiates a time delay in a time delay device 106, whose output connects to a conversion enabling terminal 100*c* of the analog-to-digital converter 100. Upon expiration of the time delay of the device 106, the converter 100 starts converting the analog signal at the terminal 98*b* into digital data for output on the conductors 84. When the conversion has been completed, a binary completion-of-conversion signal appears at the terminal 100*d*, and that signal, following a delay by a time delay device 108, resets the bistable circuit 104 whose outputs then stop the holding action of the sample-and-hold device 98 and disable the converter 100**.

A sampling command pulse is produced on the conductor 102 whenever the scanning electron beam of the vidicon camera 30 reaches a position at which it is desired to take data. Each position at which it is desired to take data is determined in succession by an address routine controller 110, FIG. 9B, which steps sequentially through a program in which it addresses a number of locations whose image density is to be measured, within each zone in turn. The manner in which the address controller 110 operates to specify points at which data are to be taken will be described more fully hereinbelow. Locations of points on the image are expressed in X and Y coordinates as shown in FIG. 9A.

The position of the scanning electron beam 55 is electronically indicated by a beam position tracker 88. A beam position comparator 90 compares digital signals from the beam position tracker 88 and the address controller 110, and produces a command to sample the video signal when the X and Y coordinates which the address controller 110 specifies are reached by the electron beam 55.

The beam tracker 88 includes a Y position counter 112, which registers the horizontal line that is currently being scanned. The counter 112 is reset or preset by an X and Y preset control module 115 in response to Y synchronizing (vertical retrace) pulses on the conductor 74, and incremented by two units upon each X synchronizing (horizontal retrace) pulse on the conductor 76. A bistable circuit 114 is controlled by interlace field control signals on the conductor 72 to store an identification of the field being scanned, that is to indicate either the field 64 or the field 66 of FIG. 8. Although the horizontal scanning lines are not precisely horizontal, they are nonetheless suitable for indicating one coordinate of the beam location.

The X coordinate of the electron beam location is indicated by an X position counter 116, which is reset or preset by the preset control module 115 having an output connected to a preset input of the X position counter 116 upon each X synchronizing signal on the conductor 76, and which is incremented in unit steps by pulses on a conductor **116*a*. Horizontal interpolation is performed. The pulses on the conductor 116*a* are produced by a phase lock oscillator 118 whose output frequency is 480 times the frequency of the X synchronizing pulses of the conductor 76. The phase lock oscillator 118 is a conventional digital type which locks to X synchronizing signals received from the conductor 76 and whose output provides signals to the X position counter 116. In this way, the phase lock oscillator 118 and the X position counter 116 operate to interpolate within each horizontal sweep of the electron beam 55 to indicate, in the X position counter, the instantaneous position of the electron beam, assuming an approximately linear horizontal sweep. Because of the second field 66 of the raster 62 starts at a value of X that represents the horizontal center of the raster, the X position counter 116 is preset to a corresponding mid-position value of X for field 66 and is reset to zero at the start of the field 64. The preset control module 115 is controlled by a signal from the bistable circuit 114** to select the proper starting value of X.

The comparator 90 operates to produce sampling commands to the video digitizer 86 as follows: When the Y position of the electron beam, as indicated by the Y position counter 112, is equal to the $Y_c$ command signal on conductors 126, a multiple-digit data comparator circuit of conventional design, which is indicated symbolically by an AND circuit 128, produces a logic 1 level at one input **130*a* of another AND circuit 130. Thereafter, when the X position of the electron beam as indicated by the contents of the X position counter 116, is equal to the $X_c$ command signal on lines 132, a multiple-digit comparator circuit 134, which receives both of those signals and which is represented symbolically on FIG. 11 as an AND gate, produces a logic 1 level at a terminal 130*b* of the AND gate 130. The electron beam 55 is then in the position for which data is desired, and the AND gate 130 emits a sampling command signal to the video digitizer 86**.

Illumination of the plate 24 by the light source 28 varies spatially on the plate. To make corrections for the spatial variations of illumination and also for variations in optical geometry from place to place, corrective data are measured and employed for compensation. Two forms of the invention are described herein to illustrate ways for making these corrections. In the first form, two calibration plates 136, 138 are first read by the apparatus, and the results are stored in memory. The data that are later obtained from a specimen plate 24 are corrected to reduce the effects that the variations of illumination would otherwise have on the final results. In employing the first illustrated form of the system, first the 0% calibrating plate 136 is placed on the table 26, FIG. 5., and light readings are taken at the points of a grid on the electric charge image 52 by the vidicon camera. The readings are stored in a memory 152 (FIG. 9B) for future use in making compensatory adjustments of data.

Next, a second printing plate 138 having 100% image area is placed on the table 26, and readings are again taken at the same grid points and stored in a second memory 154 (FIG. 9B) for future calibration use. Third, the specimen printing plate 24 for which ink control device settings are to be predetermined is placed on the table 26, and readings are again taken in sequence at all of the points of the same grid for which calibrating readings were previously made and stored.

Each reading made on the specimen plate 24 is corrected in accordance with stored readings for the same position obtained from the 0% and 100% calibrating plates. The corrected readings for the specimen plate are then accumulated, (i.e., integrated) for one entire zone such as zone **14*e* and stored in a results memory 196. This is repeated for all of the other zones of the image. It is not necessary to read calibrating plates such as the plates 136, 138 before reading every specimen plate 24 if the data already stored in the calibration memories 152, 154** was read from a type of calibration plate which is appropriate for the the specimen plate which is to be analyzed.

The address controller 110 specifies in sequence the X and Y coordinates of points at which data are to be taken. Data are taken in the same order from calibration plates as from specimen plates. Addresses are specified in the substantially rectangular X, Y coordinate system in which the origin of coordinates is taken at the upper left corner of the printing plate 24, as shown on the table 26 in FIG. 5. The X axis is parallel to horizontal sweep traces of the electron scanning beam as shown on FIG. 8, and the Y axis is parallel to the left edge of the plate 24. For simplicity, the programmer 110 does not call for taking data on at least the first horizontal sweep of the field 66, which is only a half-sweep, and on the final half-sweep at the bottom of the field 64.

The electron beam 55 of the vidicon tube 40 executes a great many scans of the raster pattern 62 during each time interval in which the address controller 110 executes only one complete data-taking program covering one plate 24. The relatively slow frequency at which the address controller 110 operates need not be synchronized with the much higher frequency at which the vidicon camera image 53 is scanned by the electron beam 55, although synchronism with a harmonic is feasible.

In the preferred embodiment being described, the address controller 110 steps through a data-taking program starting at the coordinates X=0 and Y=1. It proceeds in sequence to the point X=0, Y=2, then to X=0, Y=3, etc., i.e., down the first left-hand column of spots of FIG. 10 until all data points in that first column have been read. The spots of the second vertical column are then successively read, downward, followed by the third, fourth etc. columns. In the seven-zone embodiment being described, each ink control zone has a horizontal width of 65 such vertical columns. In a press having 46 key zones each zone would have a width of 10 such vertical columns. After all vertical columns of the first zone **14*d* have been read, the address controller proceeds to address locations in the second zone 15*d*** in a similar manner; all zones are covered successively in this way. The half lines at the top and bottom of the frame are omitted from the program for simplicity.

The address controller 110 comprises a polyphase control clock pulse generator 138, a $Y_c$ counter 140 and an $X_c$ counter 142. The subscript *c* denotes command. An operator initiates the taking of data by pressing a "start scan" pushbutton switch 144 which resets both the $Y_c$ counter 140 and the $X_c$ counter 142. Thereafter, each pulse of the clock 138 increments the $Y_c$ counter 140 by one unit, so as to step the address controller 110 progressively down the column of spots for which X=0, as described above. At a count of 480, the $Y_c$ counter recirculates to 1, and following a delay introduced by a time delay device 146, the X counter is incremented by one unit. Further pulses from the clock 138 are again counted in the $Y_c$ counter so that the taking of data then proceeds downward in the column for which X=1 as already stated. The routine is repeated until the entire plate has been scanned by the address controller 110.

A pulse is not produced by the mode control clock 138 until other components of the processing system have had sufficient time to complete their performance with regard to the previous data point in process.

A manual selector switch 150 selects a mode of operation. In the first form of the illustrated invention, which is being described, the 0% image plate provides the maximum light level signal and the 100% image plate provides the minimum light level signal, these being referred to herein as data A and data B respectively.

The 0% image plate provides data A that is used for finding both an illumination distribution factor and the 0% normalizing level, for the type of plates being employed. The 100% image plate provides data B for the illumination distribution factor and for the 100% normalizing level.

The operator places the selector switch 150 in a position A prior to taking calibration data A from the 0% image plate 136. He places the same selector switch 150 in a position B prior ro taking data B from the 100% image plate 138, and in a position Q prior to taking data Q from the specimen plate 24. One group of poles of the multiple-pole switch 150 is employed to direct data that is received from the video digitizer 86 to the memory 152, to memory 154, or to the normalizer circuit 156, depending upon whether the switch 150 is in position A, B or Q.

Other poles of the selector switch 150 are employed to direct addressing data, $X_c$ and $Y_c$, that are obtained from the address controller 110, to either the memory 152 or the memory 154, depending upon whether the switch 150 is in position A or B. The memories 152,

154 are random access semiconductor memories in the embodiment being described, but may equally well be core memories or another type if desired. Storage locations of the memory 152 are addressed by the $X_c$ and $Y_c$ data while data A are being written into memory 152 in the 0% image calibration step. Similarly, the memory 154 is addressed by the $X_c$ and $Y_c$ coordinates during the 100% image calibration step, for writing data B into the memory 154.

A mode selection output conductor 158 conducts a signal from the mode switch 150 to the memory 152 to place the memory 152 in a write mode of operation when switch 150 is in position A and in a read mode of operation when the switch 150 is in position Q. The memory 154 is placed in a write mode by a control line 160 from the switch 150 when the switch 150 is in the B position, and is placed in a read mode when the switch 150 is in the Q position.

When a specimen plate 24 is to be analyzed the mode selection switch 150 is placed in position Q, and the data Q that is obtained enters the normalizer 156 on conductors 162. At the same time, the memories 152 and 154 are read, under the control of a read or write command conductor 164 which carries a command pulse from the clock 138. The pulse signal on the conductor 164 serves as either a read or write command pulse depending upon the selected mode, at the time of the command, of the memory being commanded.

The command pulse on the conductor 164 also serves to initiate a computation by the normalizer 156 which operates on the data A, B and Q to produce normalized output data R from the normalizer 156 on data lines 166. For each datum Q obtained from an address of the plate 24 being analyzed, R is determined by computing the quotient (A-Q) divided by (A-B). The numerator represents the difference in light signals between the plate being analyzed and the 0% image calibration plate 136. The denominator represents the difference in light signals between the 100% image calibration plate 138 and the 0% image calibration plate 136. Hence, the denominator represents a 100% span of signal, while the numerator represents some specimen signal between 0% and 100%.

Figure 10:
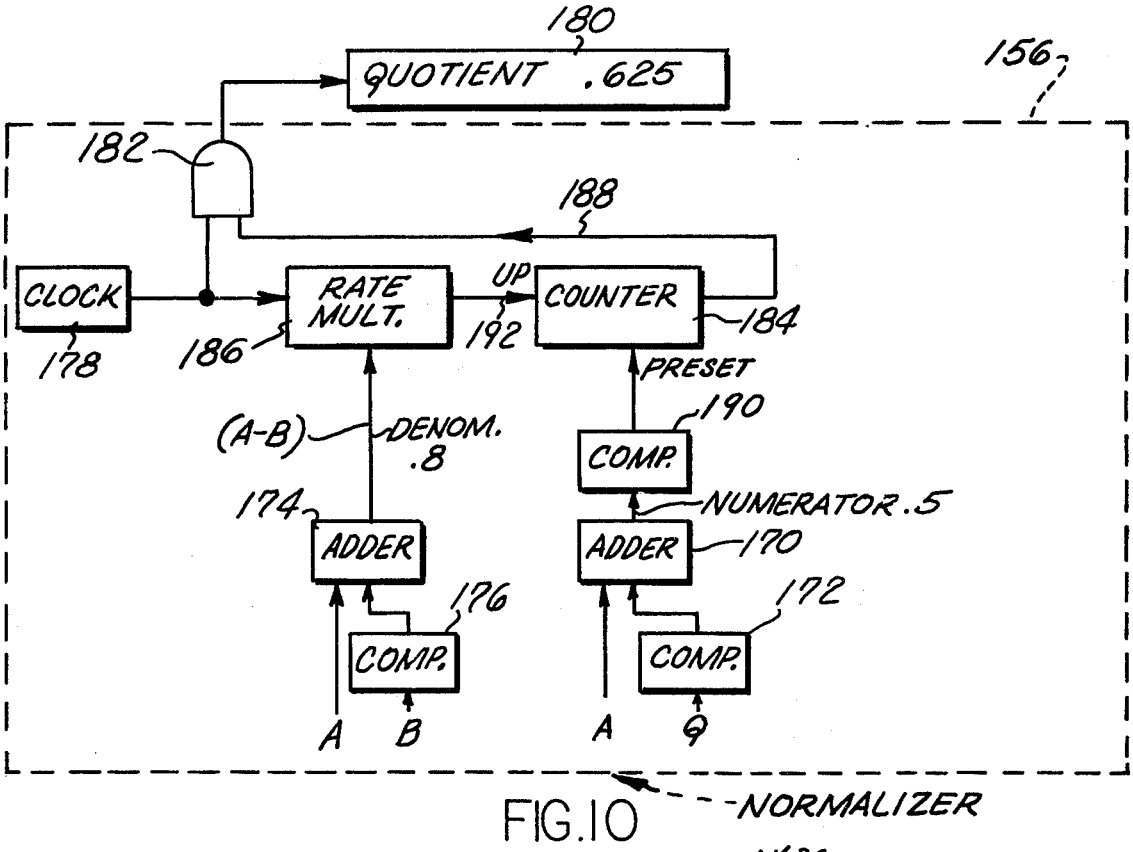
FIG. 10 is a more detailed electronics block diagram of a normalizer portion of FIG. 9B.

The normalizer 156 performs the two subtractions and the division that are indicated in the foregoing algebraic expression by means of a rate multiplier and certain other logic equipment as shown in FIG. 10. The numerator A-Q is formed by adding the data A in an adder 170 to the twos complement of the data Q, the complement being obtained by a conventional complementer 172.

In a similar manner the denominator A-B is produced by adding the data A in an adder 174 to the twos complement of the data B, the complement being obtained from a complementer 176 in a manner which is very well known in the computer art.

The quotient is obtained by providing a 1 MHz clock 178 whose output pulses are counted by a counter 180 only during a time interval T during which the pulses are admitted by a gate 182 to the counter 180 from the clock 178. The number of pulses counted by the counter 180 during the time interval T is proportional to the quotient being sought, when the time interval T is properly established.

The time interval T is properly established as the time required to count out the numerator A-Q in a counter 184, with the counter 184 being incremented by pulses from a rate multiplier 186 whose frequency is proportional to the product of the 1 MHz clock frequency and the denominator A-B. For convenience the counter 184 is preset by a complementor 190 to the complement of the numerator A-Q. Thereupon, an output signal from the counter 184 on a conductor 188 enables the AND gate 182, to start the time interval T. Pulses from the rate multiplier 186 increment the counter 184 upward until it recycles, whereupon the enabling signal on the conductor 188 changes to a disabling signal to block any further pulses from the clock 178 from reaching the counter 180. Timing pulses as required are supplied by the polyphase clock 178 by conventional circuitry.

As a numerical example, when the numerator is 0.500, its complement is 0.500 and the counter 184 is present to the binary equivalent of 0.500. If the demoninator A-B is 0.800, then the rate multiplier 186 multiplies the one MHz frequency signal which it receives from the clock 178 by 0.800 and a constant factor to produce an output frequency proportional to 0.800 MHz on a conductor 192, which leads to the count input terminal of the counter 184. The numerator A-Q must be counted out in the counter 184 before the counter 184 recycles to O. This requires a time of 0.500 divided by a number proportional to 0.800 MHz, which requires a time T proportional to 625 microseconds. During the time T that the gate 182 is enabled by the signal on the conductor 188, clock pulses spaced at one microsecond intervals enter the counter 180. If desired a binary point may be placed so that the contents of the counter may represent 0.625, which is the quotient of numerator A-Q divided by the denominator A-B. The counter 180 of FIG. 10 appears also on FIG. 9B where it is seen to serve a further function of summing, i.e. integrating, the data received from all of the data points of one zone. The counter 180 is not reset at the end of the time interval T described above for the first data point of a zone, (for example the first zone). Instead, the quotients which are computed for all of the data points within the first zone are permitted to accumulate in the counter 180, in order to integrate with respect to area, all of the data for the first zone. The accumulator 180 adds together the date for all data points in the zone, and is reset to zero after transferring its final result for the zone to a results memory 196. Each sum provides an average.

Every sixty-fifth increment of the counter $X_c$ produces an output pulse from a divide-by 65 scaler 194, whose trailing edge reset the accumulator 180, when the value of $X_c$ in the address controller 110 first corresponds to the first column of the next following zone. The output pulse signal from the divider 194 also produces a store command for the results memory 196, which, on the leading edge of the pulse immediately before reset of the accumulator 180, stores the contents of the accumulator 180 in the results memory 196. The result for each zone is stored in a different address of the results memory 196, under the control of a zone address counter 197, which is incremented by zone output pulses from the counter 194, and which is reset by a signal from the "start scan" pushbutton switch 144.

The results data regarding percentage of inked area for each of the key zones is presented to the magnetic tape output device 36 and to the display device 34 and, if desired, to an automatic key control device 198.

In addition to indicating the amount of image area individually for each zone, the apparatus indicates amount of image area for all of the zones taken together. The latter data corresponds, for example, to the total ink coverage for an entire printing plate. FIG. 9B shows digital apparatus for producing this total image data, which is displayed along with the individual zone data. An accumulator 193 accumulates zone output data that it receives, at data input terminals 193*a*, from the output of the intra-zone accumulator 180. After data from all of the zones have been accumulated in the accumulator 193, the zone counter 197 reaches a count that follows next after the count of the final zone, and this count is recognized by a comparator 195 and indicated on a terminal 193*b* of the accumulator 193. The final sum of all of the zone results is gated out of the accumulator 193, on a terminal 193*c*, to the results memory 196, where preferably it is stored until it has been displayed on the display unit 34 and on the recorder 36.

Figure 11:
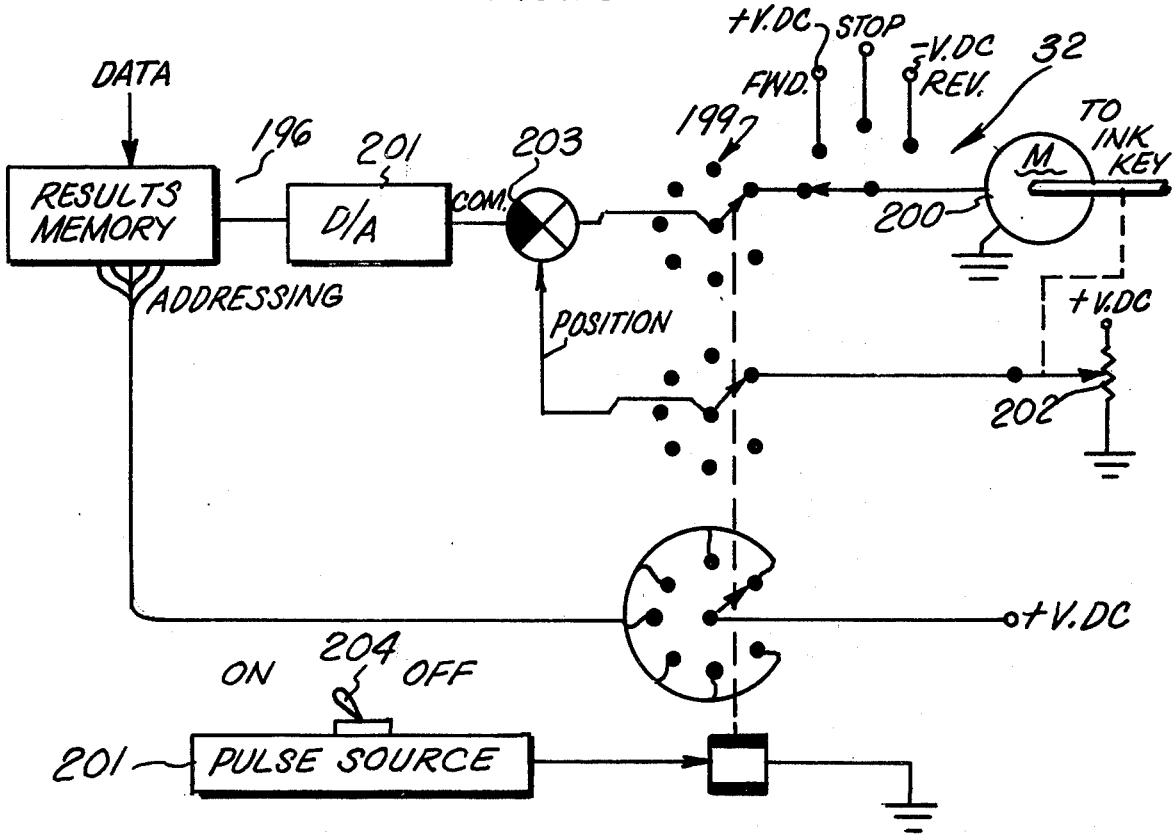
FIG. 11 is a diagrammatic showing of a system for automatically setting the ink keys of an ink fountain directly from the scanning apparatus.

The automatic key control device 198 is shown in FIG. 11. It addresses the results memory 196 successively for each of the zones and adjusts the corresponding ink key 14–20 for the respective zone to a setting that produces an amount of ink flow corresponding to the scanning results that it reads from the results memory 196. Each zone is addressed in turn by a stepping switch 199 that is actuated by a free-running pulse source 201. The results data for each successive zone is withdrawn from the results memory 196 when the zone is addressed, and is converted by a digital-to-analog converter 201, whose output is connected as a command signal to a comparator 203. Another input to the comparator 203 is obtained from the particular one of a plurality of potentiometers 202 which is linked with and indicates the position of the particular ink key currently being addressed. A bipolar output signal of the comparator 203 is distributed by the switch 199 to a bidirectional motor 200, which drives the ink key that is currently being addressed, in such a direction as to make the output signal from the potentiometer 202 equal to the command output signal of the converter 201. The time between successive pulses from source 201 is great enough to enable the full range of travel of an ink key when such is called for. In this way, all of the ink keys 14–20 are automatically driven in succession to settings corresponding to the data regarding percentage image coverage, in the results memory 196, after the operator turns on a switch 204 to start the pulse source 201.

The ink keys may also be adjusted by the manual remote control switches 32 by placing the respective switch 32 in a forward, stop, or reverse position as shown in FIG. 11.

Figure 12:
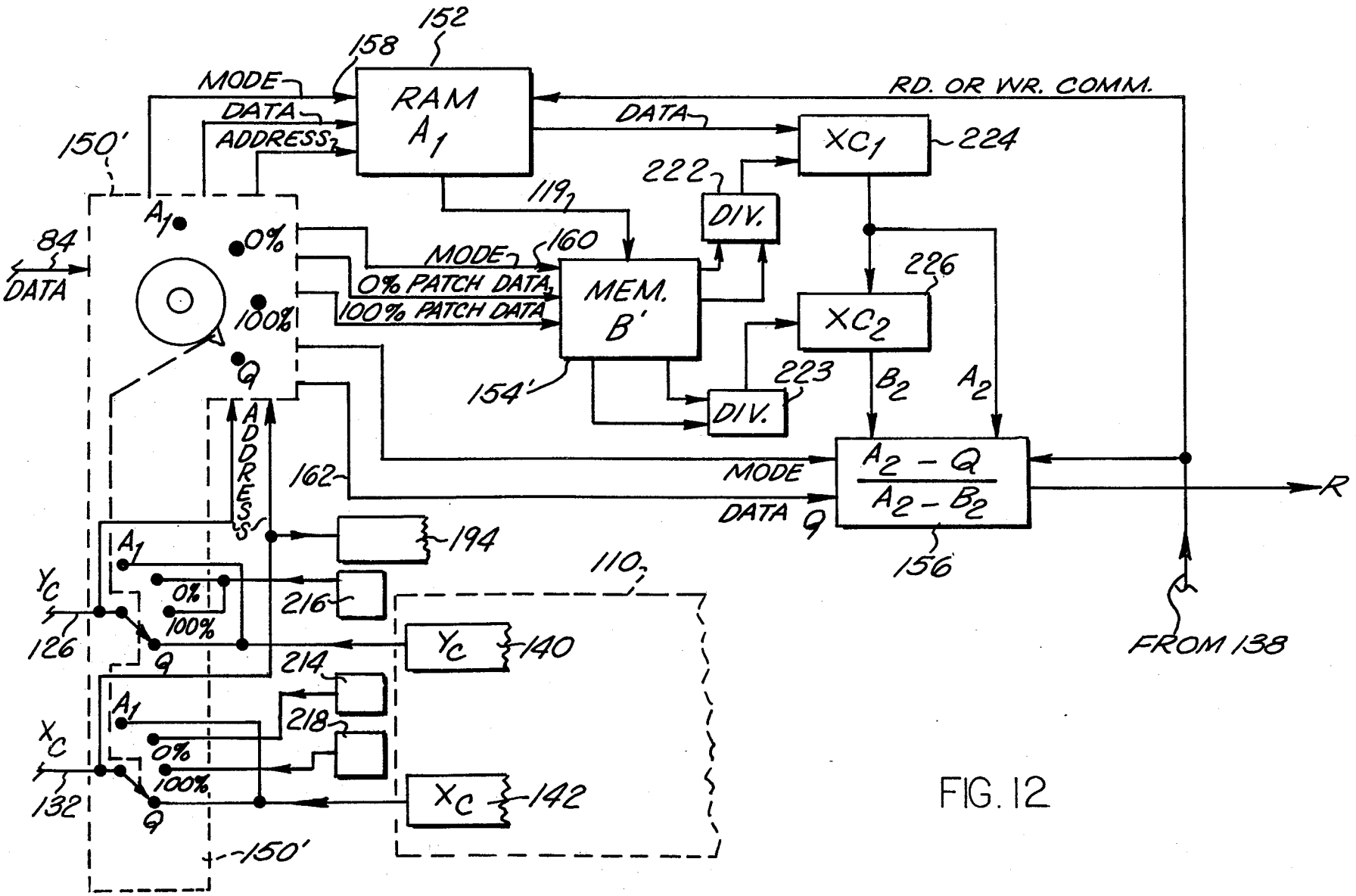
FIG. 12 is a fragmentary view of an electronic block diagram of a second illustrated form of the system, which replaces a portion of FIG. 9B.

The second illustrated form of the invention dispenses entirely with the 100% image plate 138. The 0% image plate 136 is employed to obtain information regarding spatial variations of light distribution and of the geometry of reflection into the camera 30, as before. In the second illustrated form of the invention the reflection characteristics of 0% and 100% image areas are measured for the particular specimen plate 24 which is to be analyzed, so that it is not necessary to assume that 0% and 100% image areas have the same reflectivity on the test specimen plate 24 as on a calibration plate. Data that are necessary for normalizing the light readings between limits of 0% and 100% are obtained by measuring the light reflected from two test patches in a nonprinting margin of the image-bearing specimen plate 24. FIG. 5 shows these 0% and 100% test patches 210, 208, respectively, which are located close together on plate 24. The second illustrated form of the invention is shown in FIG. 12 insofar it differs from the first form. FIG. 12 replaces a portion of FIG. 9B.

The operating procedure for the second illustrated form of the invention involves first placing the 0% uniform calibration plate 136 on the table 26 as before, to ascertain the light distribution on the table. A mode selector switch 150', FIG. 12, is placed in a position $A_1$, and the start scan switch 144 (FIG. 9B) is depressed by the operator. Light readings are then taken in rapid succession at the points of a grid and the readings are stored in the random access memory 152, as was described in detail in connection with the first illustrated form of the invention.

The 0% calibration plate 136 is then removed from the table 26 and the specimen plate 24 which is to be analyzed is placed there, FIG. 5. The mode selector switch 150' is moved to the 0% position preparatory to measuring light reflected from the 0% test area 210 of the plate 24. In this position of the switch 150' the $X_c$ and the $Y_c$ coordinate position commands are provided by address storage circuits 214 and 216 respectively, FIG. 12. The address circuits 214, 216 contain the coordinates of the 0% test area 210. Light which is reflected from that area is measured and the data are recorded in a first location of a memory 154'. At the same time, the data that was previously stored in the memory 152 at an address having the same coordinates as the 0% test patch, is copied out of the memory 152 on a line 119 and into a second storage location of the memory 154'.

Next the operator places the mode selector switch 150' in a position marked 100%, which among other things, directs the apparatus to the coordinates of the 100% test patch 208, by addressing that patch with address storage circuits 218, 216. The light reflected from the 100% test patch 208 is recorded in a third storage location of the memory 154' to provide calibration information as to the reflectivity of a 100% area of the particular specimen plate 24 whose image areas are subsequently to be analyzed.

In the next step of the process the operator places the mode selector switch 150' in a position Q. In this position the addressing of locations to be measured will again be performed by the grid addressing circuit 110, which also addresses the memory 152, but the sequential addressing does not start as yet.

When the mode selector switch 150' is first moved to the Q position, data are read simultaneously from all three storage locations of memory 154', into the conventional dividers 222, 223 which are both similar to the divider of FIG. 10 described in very great detail above. The divider 222 automatically computes a ratio $C_1$. The numerator of the ratio $C_1$ is the 0% test patch reading of plate 24 as described above, which was previously read when the mode selector switch 150' was in the 0% position, and which was stored in the memory 154'. The denominator of the ratio $C_1$ is the light measurement previously made on the 0% calibration plate 136 at the X and Y coordinates at which the 0% test patch 210 would have been located if the specimen test plate 24 had been on the table at the time of the reading. It was copied from the memory 152 into the memory 154'. The ratio $C_1$, represents a ratio of 0% reflection characteristics of the specimen image plate 24 compared with the calibration plate 136. The ratio $C_1$ is loaded into a multiplier 224.

The dividing circuit 223 computes a second ratio $C_2$, which represents the ratio of light reflected from the 100% test patch 108 of the specimen plate 24 (numerator) to light reflected from the 0% test patch 210 of the same specimen plate 24 (denominator). These data are available in the memory 154'. The denominator of $C_2$ is the same datum that served as the numerator of the ratio $C_1$. The ratio $C_2$ is stored in a second multiplier 226. The operator then presses the start scan push button 144, and the image plate 24 is completely scanned automatically just as was done in the first form of the invention. However, as shown in FIG. 12, data read from the random access memory 152 and transmitted into the computation circuit 156 are multiplied by $C_1$ and $C_2$ in the multipliers 224, 226 before being entered into the circuit 156.

The operation of the computation circuit 156 is the same as was described above in detail. However, as shown in FIG. 12, data read from the random access memory 152 are multiplied by the ratio $C_1$ in the multiplier 224 to produce a quantity $A_2$ for use in the multiplier 156 in place of the previously used quantity A. No data are read from the memory 154' during image scanning of the plate 24. Instead, the necessary data $B_2$ are obtained by multiplying the data $A_2$ by the ratio $C_2$ in the multiplier 226, the data $B_2$ taking the place of the data B of the first form of the invention. As scanning progresses, corrections are therefore made in the data Q for spatial variations of illumination as determined by the calibration plate 136, and further corrections are made to normalize the data Q, on the basis of readings made from the 0% test patch 208 and the 100% test patch 210 of the specimen image plate 24.

If desired, the light reflected from the test areas 208, 210 may be measured at a plurality of points within each of the test areas, 208, 210, and the readings may be averaged to obtain a more accurate reading. The design of circuits for accomplishing a small scan routine within each of the test patches 208, 210 is well known in the art and, in fact, is shown by the addressing circuit 110 described in detail above.

In another minor variation of the second embodiment of FIG. 12, the 0% and 100% calibration areas 210, 208 of plate 24 are measured as a part of the same scan as the data-taking scan of the image. The 0% and 100% positions of the mode switch 150 are eliminated. The operating procedure is to scan the calibration plate 136 with the mode switch 150 in the $A_1$ position, then to scan the specimen plate 24 with the mode switch 150 in the Q position. The test patches are encountered early in the scanning raster pattern. As in the foregoing embodiments, the addresses of the test patches 208, 210 are stored in a memory before measurements are begun.

Certain simplifying approximations are implicit in the second illustrated form of the invention. The light reflected into the camera is a function of spatial coordinates X and Y on the image plate 24, and also of the percentage of etching the area being instantly examined, i.e., either 0% or 100%. Moreover, it is a function of individual characteristics of the particular plate being measured. An assumption is made that the reflected light is a product of three functions, the first of which is a function only of the spatial variables X and Y, the second of which is a function only of the etching, i.e., 0% or 100% and the third of which is a function only of individual differences between printing plates. This assumption that the reflected light is expressible as a product of three functions, each having fewer variables, enables the computation of a correction factor for 0% reflectivity ($A_2$) and for 100% reflectivity ($B_2$) for all of the space coordinates X, Y by using the multipliers 224, 226.

A second approximation that is implicit in the second form of the invention illustrated herein is that the test patches 208, 210 are close enough together to be identically illuminated, and to reflect light in identical directions, the only difference in their reflection behavior being due to the 0% and 100% etching of their surfaces.

The image-bearing member 24 need not be a printing plate, but could instead be an image printed by ink, or a transparency such as, for example, the type of transparency sometimes employed for producing printing plates. If the image-bearing member 24 is a transparency, the light sources 28 could be positioned beneath the transparency 24 in the table 26.

The addressing equipment 199, 201 of FIG. 11 may be used also for memory zone scanning for the display 34 and for the recorder 36.

Some portions of the embodiment described above can readily be replaced by a digital computer in an alternative embodiment of the invention. For example, the functions of the following components could be performed by a small digital computer: The address controller 110, portions of the mode selector 150, the memories 152, 154, and 196, the normalizer 156, the accumulator 180, the divider 194, the zone counter 197, portions of the automatic key adjustment device 198, and some portions of the sampling and digitizing equipment 82.

If desired, the memories 152, 154 may be large enough to accommodate calibration data for more than one type of printing plate, in which case the selector switch 150 would include additional switching functions for selecting portions of the memory which store data corresponding to the type of plate which is to be analyzed.

Clearly, the concepts of the invention are applicable to systems in which the locations of the ink zone boundaries are adjustable or in which the zones are not all of the same size.

Provision is made for inserting a color selection filter 206 on the light path between the image 24 and the camera tube 30, as shown in FIG. 7. When the apparatus is employed to examine a multicolor object, such as a completed printed sheet from a multi-color press, a color filter such as a red, green, or blue filter can be employed to give an approximate indication of the percentage coverage of the selected color even in the presence of several other colors. The color filter 206 therefore makes the apparatus useful for, among other things, quality control of a printed image having more than one color.

For convenience, the image at the photosensitive surface may be defocused if desired, and the term image includes unfocused images.

What is claimed is:

1. Apparatus for predetermining the settings of a plurality of ink control devices which control the amount of ink applied to respective circumferential zones of a printing cylinder for printing an image having ink zones where the ink supply rate of each zone is controlled by a respective one of said ink control devices comprising means for supporting an image-bearing member having a first image which corresponds to the image to be printed and zones which correspond to said ink zones, each of said zones comprising sub-areas therein, means for directing light onto said image-bearing member to project light therefrom which varies spatially in accordance with at least one zone of said first image, means for receiving at one time the projected light from at least said one zone comprising camera means having a photosensitive area responsive to said projected light for producing separate electrical signals from sub-areas of said photosensitive area which vary in accordance with the light projected from respective ones of said sub-areas of said zone, and means distinct from said photosensitive area and individually rsponsive to said separate electrical signals for establishing for each of said zones received by said camera means an individual resultant signal which has a characteristic indicating the approximate ink supply rate required for the zone and including means for approximately integrating signals derived from said separate electrical signals that are produced for the respective sub-areas of the zone, whereby each of said individual resultant signals is indicative of a predetermined setting for one of the ink control devices.

2. Apparatus for predetermining the settings of a plurality of ink control devices as defined in claim 1 and wherein said means for receiving the projected light comprises means for producing from said projected light a second image corresponding at least to said one zone, and said camera means includes electron beam means for spatially scanning aid sub-areas of said zone of said second image to produce sequentially said separate electrical signals whereby the separation of said separate signals is temporal separation.

3. Apparatus for predetermining settings of a plurality of ink control devices as defined in claim 2 and wherein said second image comprises an electric charge image also having at least a respective zone corresponding to said one zone, and wherein said means for spatially integrating includes means for adding together within said zone the signals derived from said sequential electrical signals that are produced by the scanning of said electron beam means.

4. Apparatus for predetermining the settings of a plurality of ink control devices as defined in claim 2 and wherein said electron beam means for scanning comprises means for scanning each of said zones by at least a portion of each of a plurality of scanning sweeps.

5. Apparatus for predetermining the settings of a plurality of ink control devices as defined in claim 1 and wherein said image-bearing member comprises a lithographic printing plate having inking and non-inking portions for producing said image.

6. Apparatus for predetermining the settings of a plurality of ink control devices as defined in claim 1 and further comprising means for combining said individual resultant electrical signals for all of said zones that are received to produce an overall signal corresponding to the entire area of the image for which projected light is received by said camera means.

7. Apparatus for predetermining the settings of ink control equipment of a printing press having a member bearing a pattern to be printed comprising an optical system viewing said member and producing an image of at least a portion of said pattern, a camera including camera tube means for viewing said image of said portion of said pattern and for producing signals according to the inked and uninked areas required for printing said portion of said pattern, and means for approximately summing said signals with respect to the inked area of said portion of said pattern to produce a signal indicative of the overall inked area of said portion of said pattern, whereby said signal indicative of the overall inked area of said portion of said pattern is indicative of a predetermined setting for ink control equipment.

8. Apparatus for predetermining the settings of a plurality of ink control devices which control the amount of ink applied to respective circumferential zones of a printing cylinder for printing an image having ink zones where the ink supply rate of each zone is controlled by a respective one of said ink control devices comprising means for supporting an image-bearing member having a first image which corresponds to the image to be printed and zones which correspond to the ink zones thereof, means for directing light onto said image-bearing member to project light therefrom which varies spatially in accordance with at least a zone of said first image, camera means spaced away from said image-bearing member and responsive to said projected light projected across the intervening space from said member for producing a second image having zones corresponding to said ink zones, said camera means comprising camera tube means receiving said second image for producing electrical signals varying in accordance with the light striking said camera tube means at different areas of said second image, and means responsive to said electrical signals for establishing for each of said zones an individual resultant signal which has a characteristic indicating the approximate ink supply rate required for the zone, including means for approximately adding together signals derived from said electrical signals that are produced within each zone by said camera means, whereby the settings for the ink control devices are predetermined.

9. Apparatus for predetermining the settings of a plurality of ink control devices as defined in claim 1 and further comprising means for correcting for non-uniform illumination of said image-bearing member, said correcting means comprising a uniformly reflecting surface adapted to be illuminated in place of said image-bearing member, means for storing information contained in said separate electrical signals from said sub-areas obtained when said uniformly reflecting surface is in place, and means for combining said information with data from respective ones of said sub-areas obtained when said image-bearing member is in place to compensate said data for non-uniformity of illumination of said image-bearing member.

10. Apparatus for predetermining the settings of a plurality of ink control devices as defined in claim 9 and further comprising means for normalizing said data obtained from respective ones of said sub-areas when said image-bearing member is in place, said means for normalizing comprising means for obtaining at least one of said separate electrical signals from a sub-area corresponding to a known 0% image sub-area of said image-bearing member and for obtaining at least one separate electrical signal from a sub-area corresponding to a known 100% image area of said image-bearing member, said normalizing means further comprising means for combining said known 0% and 100% electrical signals with said data from respective ones of said sub-areas obtained when said image-bearing member is in place to normalize said data in a 0% to 100% range.

11. A method of predetermining the settings of a plurality of ink control devices which control the amount of ink applied to respective circumferential zones of a printing cylinder for printing an image having ink zones where the ink supply rate of each zone is controlled by a respective one of said ink control devices which comprises the steps of directing light onto an image-bearing member having a first image which corresponds to the image to be printed and zones which correspond to the ink zones thereof, projecting light from at least a portion of said first image onto a camera means having a photosensitive area to form a second image on said photosensitive area and having at least one zone corresponding to an ink zone of the first image, producing from said second image a plurality of first electrical signals varying in accordance with the light of different portions of said second image.

and establishing in response to said first electrical signals a respective resultant electrical signal for each zone, each of which resultant signals has a magnitude as a function of the ink supply rate required for the zone, including approximately summing signals derived from said first electrical signals that are produced within each zone, to thereby predetermine the settings for the plurality of ink control devices.

12. A method of predetermining the settings of a plurality of ink control devices as defined in claim 11 and wherein said steps of directing light onto said image-bearing member comprises directing light onto an opaque member having image portions and non-image portions of differing light reflection characteristics and corresponding to the image to be printed.

13. A method of predetermining the setting of a plurality of ink control devices as defined in claim 11 and wherein said step of producing first electrical signals from said second image comprises scanning the zones of said second image with an electron beam.

14. A method of predetermining the settings of a plurality of ink control devices as defined in claim 13 and wherein said step of scanning the zones of said second image comprises scanning all of said zones statically by moving only said electron beam, said camera means being stationary during said scanning.

15. A method of predetermining the settings of a plurality of ink control devices as defined in claim 11 and further comprising a step of producing a cathode ray tube display of the magnitudes of said resultant signals.

16. A method of predetermining the settings of a plurality of ink control devices as defined in claim 11 and wherein said step of projecting light from said first image to a camera means comprises adjusting the ratio of the size of said second image relative to the size of said first image.

17. A method of predetermining the settings of a plurality of ink control devices as defined in claim 11 and comprising the further steps of arranging a plurality of remote control means in alignment with zones of the first image which correspond to the circumferential zones in which the ink supply rate is controlled by respective ones of said ink control devices, and adjusting respective ones of said plurality of ink control devices in accordance with said respective resultant electrical signals.

18. A method of predetermining the settings of a plurality of ink control devices as defined in claim 11 and comprising the further steps of providing remotely controllable drive means for individually driving each of said plurality of ink control devices, and utilizing said respective resultant electrical signal for each zone to operate automatically each of said respective drive means to adjust said ink control devices to a position dependent upon said respective resultant electrical signal.

19. A method as defined in claim 11 and further comprising a step of providing means for calibration including a member having an area known to be a non-image area; illuminating, viewing, and scanning as for said first image; establishing a 0% image signal based upon light reflected by a portion of said area; and storing the value of 0% signal.

20. A method of predetermining the settings of a plurality of ink control devices as defined in claim 11 and further comprising a step of producing a display of the magnitudes of said resultant signals including automatically establishing a display scale factor and an offset level of said display of said magnitudes based upon measurements of 0% and 100% image areas.

21. A method of predetermining the settings of a plurality of ink control devices as defined in claim 11 and further comprising the steps of providing first means for calibration including a member having an area known to be an image area; directing light thereto, projecting light therefrom, and producing electrical signals as for said first image; establishing a 100% image signal based upon light reflected by a portion of said image area; and storing the value of said 100% signal.

22. A method of predetermining the settings of a plurality of ink control devices as defined in claim 21 and further comprising steps of providing second means for calibration including a member having an area known to be a non-image area; directing light thereto, projecting light therefrom, and producing electrical signals as for said first image; establishing a 0% signal based upon light reflected by a portion of said non-image area; and storing the value of said 0% signal.

23. A method as defined in claim 22 and further comprising a step of combining at least one of said 100% and 0% signals established for said known image and known non-image areas respectively with a signal derived from said image-bearing member to offset said resultant electrical signal in dependence upon said light reflected by a portion of the member of said first and second means for calibration.

24. A method as defined in claim 22 and further comprising a step of producing a difference signal dependent upon the difference between said 100% signal from a known image area and said 0% signal from a known non-image area, and combining said difference signal with a signal derived from said image-bearing member to normalize the scale of said resultant electrical signal between 0% and 100%.

25. A method as defined in claim 24 and wherein said step of establishing a respective resultant electrical signal for each zone comprising sampling said first electrical signals at a plurality of positions within each of said zones, and wherein said steps of establishing said 100% and 0% electrical signals based upon light reflected from a portion of each of said image area and said non-image area respectively comprise establishing 100% and 0% electrical signals respectively for a position approximately the same as one of said plurality of positions at which said first electrical signal was sampled, and wherein said step of combining comprises automatically computing a normalized quantity corresponding to signals of said position, and further comprising the steps of repeating said steps of establishing 100% and 0% signals at others of said plurality of positions, and repeating said step of automatically computing said normalized quantity corresponding to signals of said other positions, and wherein said step of approximately summing comprises approximately summing all of said computed normalized quantities that are produced for each of said zones to produce a separate sum for each zones.

26. A method as defined in claim 11 and further comprising a step of combining said respective resultant electrical signals from all of said zones to produce a total signal indicative of ink supply rate required for the entire second image.

27. A method as defined in claim 11 and further comprising steps of calibration including illuminating, viewing, and scanning a uniform member, storing data based upon light reflected by said uniform member for recording a spatial light distribution, measuring light reflected by a known 0% image portion of a member and recording the measured data, measuring light reflected from a known 100% image portion of a member and recording the measured data, combining said distribution data, said 0% data, and said 100% data, and normalizing and compensating said respective resultant electrical signal for each zone in accordance therewith.

28. Apparatus for predetermining the settings of a plurality of ink control devices which control the amount of ink applied to respective circumferential zones of a printing cylinder for printing an image having ink zones where the ink supply rate of each zone is controlled by a respective one of said ink control devices comprising;

means for supporting an image-bearing member having a first image which corresponds to the image to be printed and zones which correspond to said ink zones, each of said ink zones comprising sub-areas therein;

means for directing light onto said image-bearing member to project light therefrom which varies spatially in accordance with at least one zone of the image;

means for scanning responsive to said projected light for sequentially producing separate electrical signals from sub-areas of said zones as a result of sequential line scans each covering a plurality of zones, said electrical signals being dependent on the light projected from respective ones of said sub-areas of said zone; and means coupled to said scanning means for receiving said signals in sequence and individually rsponsive to said separate electrical signals for approximately integrating said signals by zone to provide individual resultant signals, whereby said individual resultant signals are indicative of predetermined settings for the ink control devices.

29. Apparatus for predetermining the settings of a plurality of ink control devices as defined in claim 28 and wherein said scanning means comprises means for producing digital separate electrical signals for each sub-area.

30. Apparatus for predetermining settings of a plurality of ink control devices as defined in claim 29 wherein said means for integrating comprises means for adding together within said zone the signals derived from the sequential electrical signals that are produced by said scanning means.

31. Apparatus for predetermining the settings of a plurality of ink control devices as defined in claim 29 and wherein said means for scanning comprises means for storing said separate electrical signals identified with the zone in response to which each of said separate electrical signals is derived.

32. Apparatus for predetermining the settings of a plurality of ink control devices as defined in claim 28 and wherein said image-bearing member comprises a lithographic printing plate having inking and non-inking portions for producing said image.

33. Apparatus for predetermining the settings of a plurality of ink control devices as defined in claim 28 and further comprising means for combining said individual resultant electrical signals for all of said zones that are received to produce an overall signal corresponding to the entire area of the image for which projected light is received by said means responsive to said projected light.

* * * * *